United States Patent [19]

Krumreich

[11] Patent Number: 4,597,623

[45] Date of Patent: Jul. 1, 1986

[54] CONNECTOR ASSEMBLY

[75] Inventor: Charles L. Krumreich, Indianapolis, Ind.

[73] Assignee: AT&T Bell Laboratories, Murray Hill, N.J.

[21] Appl. No.: 749,133

[22] Filed: Jun. 27, 1985

Related U.S. Application Data

[63] Continuation of Ser. No. 393,403, Jun. 29, 1982, abandoned.

[51] Int. Cl.[4] ..... H01R 9/08

[52] U.S. Cl. ..... 339/97 P; 339/98

[58] Field of Search ..... 339/94 M, 97 R, 99 R, 339/98, 97 P, 96

[56] References Cited

U.S. PATENT DOCUMENTS

| | | | |
|---|---|---|---|
| 1,173,099 | 2/1916 | Davis | 339/98 |
| 1,337,329 | 4/1920 | Schäfer | 339/97 R |
| 2,361,536 | 10/1944 | Frank | 339/97 R |
| 2,653,178 | 9/1953 | Ruffle | 339/97 R X |
| 2,934,737 | 4/1960 | Gibson | 339/97 R |
| 3,012,219 | 12/1961 | Levin et al. | 339/98 |
| 3,189,863 | 6/1965 | Leach | 339/99 |
| 3,217,286 | 11/1965 | Duffield | 339/99 |
| 3,218,602 | 11/1965 | Morse | 339/97 R |
| 3,258,733 | 6/1966 | Elm | 339/98 |
| 3,594,703 | 7/1971 | Holtzapple | 339/97 R |
| 3,629,804 | 12/1971 | Behymer | 339/98 |
| 3,694,792 | 9/1972 | Wallo | 339/97 R |
| 3,836,943 | 9/1974 | Horak | 339/97 P |
| 3,935,637 | 2/1976 | Bunnell | 29/866 |
| 4,040,701 | 8/1977 | Gressitt | 339/99 |
| 4,075,758 | 2/1978 | Parsons et al. | 29/866 |
| 4,195,194 | 3/1980 | Kuster et al. | 339/97 R X |
| 4,210,378 | 7/1980 | Baribeau | 339/97 R |
| 4,324,450 | 4/1982 | Weisenburger et al. | 339/97 R |

FOREIGN PATENT DOCUMENTS

| | | | |
|---|---|---|---|
| 481232 | 5/1952 | Canada | 339/97 R |
| 1765202 | 7/1971 | Fed. Rep. of Germany | 339/97 P |
| 2142930 | 3/1973 | Fed. Rep. of Germany | 339/97 R |
| 717319 | 10/1954 | United Kingdom | 339/98 |

OTHER PUBLICATIONS

Scotchflex 700 Flat Adhesive Station Wire and Connector Accessories, 3M Company.

Scotchflex 700 Flat Adhesive Station Wire and Connector Accessories–Telephone Installation Systems 3M Practice, 3M Company.

*Primary Examiner*—William R. Briggs

*Attorney, Agent, or Firm*—Harry L. Newman; R. F. Kip, Jr.

[57] ABSTRACT

A connector assembly comprises an electrically nonconductive post (300) having a plurality of channels (310) in its upper surface for receiving individual insulated conductors. The upper surface of the post also includes slots (320) extending orthogonal to the channels (310). The slots (320) receive legs (220) of an inverted U-shaped contact (200), the legs comprising slotted beams (222) that depend from a base (210) of the contact. The contact base (210) is captured on a screw terminal (100) which threads onto the upper surface of the post (300). The screwing in of the screw terminal (100) causes the slotted beams (222) of the contact (200) to penetrate the insulation of the conductors placed in the channels (310) to electrically interconnect the conductors, contact (200), and screw terminal (100).

4 Claims, 9 Drawing Figures

CONNECTOR ASSEMBLY

This is a continuation of application Ser. No. 393,403 filed June 29, 1982 abandoned.

TECHNICAL FIELD

This invention relates to the field of electrical connectors and within that field to a connector assembly adapted to interconnect conductors that are terminated in a variety of ways.

BACKGROUND OF THE INVENTION

In the interconnection of electrical conductors, a number of differnt terminations are often encountered at the same location. In the telephone industry, for example, the conductors of the line cord of a telephone set have been terminated by spade-tip terminals. On the other hand, the conductors of the telephone wire installed on the surface or within the walls of a building have been stripped to provide a bare-ended termination. In the past, these two terminations have been interconnected by being placed under the head of a screw terminal that was part of either a surface mounted or flush mounted connecting block.

More recently, a snap-on terminal of the type disclosed in U.S. Pat. No. 4,188,505, which issued to R. J. O'Connor on Feb. 12, 1980, has been introduced. This terminal snaps onto the head of a screw terminal, and one use of the snap-on terminal has been to permit a customer to add a modular jack enclosure to the connecting block. The customer is then able to install any telephone having a modular plug-ended line cord. Thus, it is seen that with these three types of terminations, the screw terminal continues to serve as an adequate connector in the telephone industry.

Residential customers are now being allowed to install telephone wire from the entry point of a telephone line into their dwelling unit or from any point within their dwelling unit where existing telephone wire may be accessed. This telephone wire typically comprises a plastic sheath surrounding a group of individually insulated conductors. Consequently, for the customer to use the existing connector hardware, it is necessary once the sheath has been removed, for the customer to use a wire stripping tool to remove insulation from the end of each conductor and/or to apply to the end of each conductor a terminal that is compatible with existing hardware.

The easiest and least expensive termination for the novice customer to deal with is just the simple insulated conductor. This eliminates the need for a wire stripping tool and/or the need to apply a terminal to the conductor. So, a connector that permits the use of this type of termination is highly desirable. However, because there are tens of millions of households where telephone wiring and telephones are already in place, it is also very important for the connector to be sufficiently versatile to permit interconnection with bare-ended conductors and terminal terminated conductors.

SUMMARY OF THE INVENTION

A connector assembly in accordance with the present invention allows the user to make electrical connection to an insulated conductor and/or to electrically interconnect between insulator conductors. Furthermore, the connection is easily accomplished by means of a single tool, such as the ordinary screwdriver. Still further, the connector permits interconnection with both bare-ended and terminal terminated conductors.

In an illustrative embodiment, the connector assembly comprises an electrically nonconductive post having a plurality of channels in its upper surface for receiving individual insulated conductors. The upper surface of the post also includes slots extending orthogonal to the channels. The slots receive the legs of an inverted U-shaped contact, the legs comprising slotted beams that depend from a base of the contact. The contact base is captured on a screw terminal which threads onto the upper surface of the post. The screwing in of the screw terminal causes the slotted beams of the contact to penetrate the insulation of the conductors placed in the channels to electrically interconnect the conductors, contact, and screw terminal. The connector assembly thereby enables interconnection between insulated conductors, a bare-ended conductor placed under the screw terminal, a snap-on terminal placed on the screw terminal, or a spade-tip terminal placed under the screw terminal.

BRIEF DESCRIPTION OF THE DRAWING

These and other aspects of this and other illustrative embodiments are more readily understood by reference to the drawing wherein.

DETAILED DESCRIPTION

Figure 1:
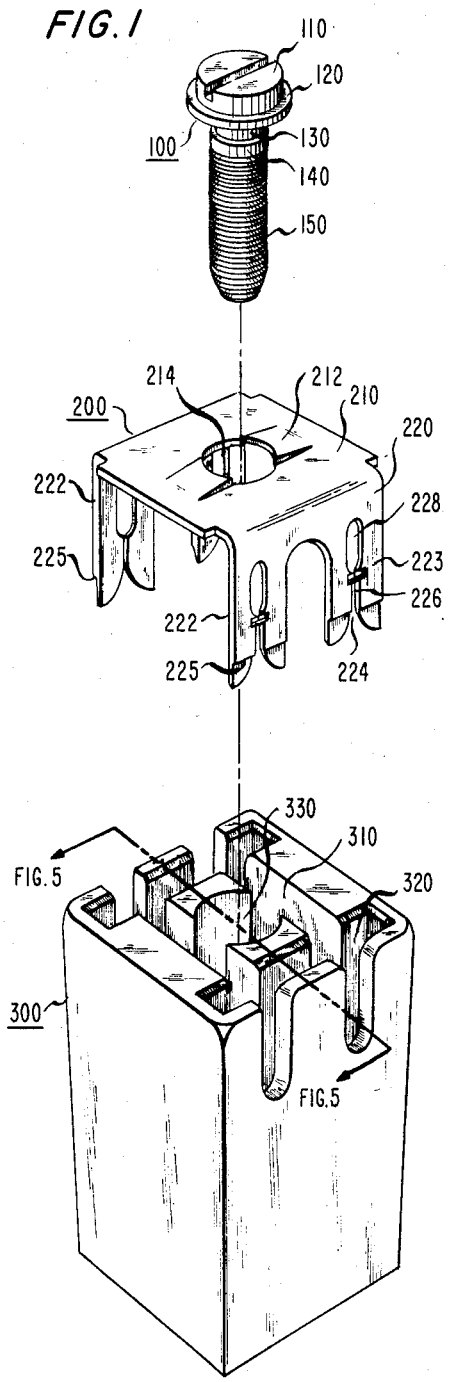
FIG. 1 is an exploded perspective view of a basic embodiment of applicant's invention.

Referring to FIG. 1 of the drawing, a connector assembly in accordance with the present invention comprises a screw terminal 100, a contact 200, and a post 300. The screw terminal 100 includes a slotted head portion 110 that is cylindrical in shape in order to be readily engaged by a snap-on terminal of the type disclosed in the previously mentioned U.S. Pat. No. 4,188,505. Underlying the head portion 110 is a circular flange portion 120 of greater diameter than the head portion which, among other things, serves to provide increased contact surface for a spade-tip terminal or a bare-ended conductor placed beneath the head portion.

A neck portion 130, collar portion 140, and threaded portion 150 depends from the flange portion 120, the collar portion being located between the neck portion and the threaded portion. The neck portion 130 is of lesser diameter than the collar portion 140 which is of greater diameter than the outside diameter of the threaded portion 150. The threaded portion 150 is advantageously of the self-tapping type and is tapered at its lower end. The screw terminal 100 is formed from an electrically conductive material such as steel.

Figure 2:
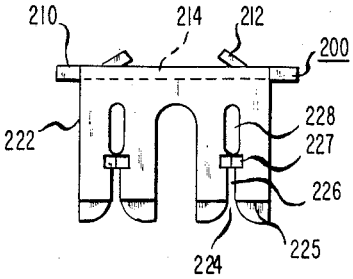
FIGS. 2 and 3 are respective front and side views of a slotted beam contact used in the embodiment.
Figure 3:
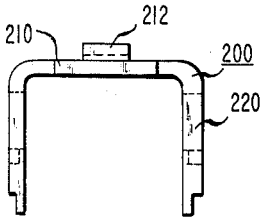

Referring now to FIGS. 1, 2 and 3, the contact 200 comprises an inverted U-shaped member having a base 210 from which legs 220 depend. The base 210 is basically flat, except that it has a pair of opposed tabs 212 adjoining a central opening 214 that are initially in an upwardly inclined position. With the tabs 212 in this position, the opening 214 is of a size to permit both the threaded portion 150 and the collar portion 140 of the screw terminal 100 to pass through the opening. The tabs 212 when lying in the same plane as the rest of the base 210, reduce the size of the opening 214 so that it is smaller than the diameter of the collar portion 140. In both instances, the opening 214 is of lesser size than the flange portion 120 of the screw terminal 100.

Each leg 220 comprises a pair of slotted beams 222 and each slotted beam includes a pair of furcations 223 which define an entry way 224, an engaging slot 226, a stop 227, and an extension slot 228. The entry way 224 is beveled to facilitate engagement of the slotted beam 222 with an insulated conductor. In addition, the entry way 224 is of lesser thickness than the remainder of the slotted beam 222, there being an abrupt change in the thickness of each furcation 223 that provides a ledge 225 at the lower end of the engaging slot 226. This configuration serves to shear away the insulation from an insulated conductor as it enters the engaging slot 226.

The engaging slot 226 is itself of lesser width than the diameter of the conductor thereby bared so that the furcations 223 are deflected away from one another. As a result, the furcations 223 tightly grip the conductor and a good electrical connection is obtained. The stop 227 serves to prevent the conductor from entering the extension slot 228 which is of greater width than the engaging slot 226, the extension slot serving to provide the furcations 223 with the desired deflectability. The contact 200 is formed from a resilient electrically conductive material such as phosphor bronze. Further details with respect to insulation penetrating slotted beam contacts of this type are disclosed in U.S. Pat. No. 4,333,700 issued to W. E. Pugh III on June 8, 1982 and assigned to the assignee of the present application.

Figure 4:
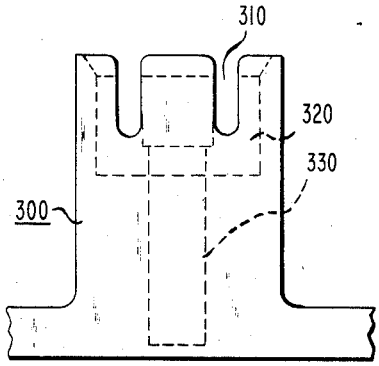
FIG. 4 is a front view of a post for receiving the contact.
Figure 5:
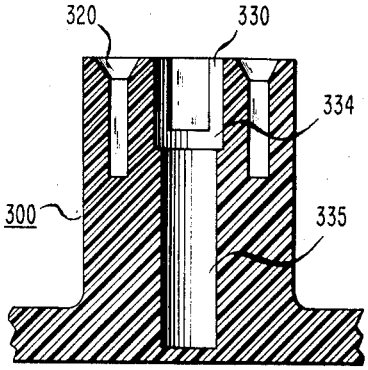
FIG. 5 is a sectional view of the post taken along line 5—5 of FIG. 1.

Turning now to FIGS. 1, 4 and 5, the post 300 is advantageously a rectangular member molded from an electrically nonconductive plastic such as polycarbonate. In addition, the post 300 is typically molded as an integral element of another structure, the post upstanding from a base element of this structure.

The upper surface of the post 300 has a pair of spaced parallel channels 310 formed in it that extend completely through opposing sides of the post. The width of each channel is such as to accommodate a single insulated conductor. While the channels 310 are shown to be of equal width, in some applications it may be desirable to interconnect conductors of different diameter size and therefore have channels of different width. The height of the channels 310 is such as to retain the insulated conductors in the channels without need of any additional holding element and to permit engagement of the contact 200 with the post 300 without engaging the insulated conductors. Here again, while the channels 310 are shown to be of equal height, in some applications it may be desirable to make them and the associated slotted beams 222 of the contact 200 of unequal height so as to have the insulation of one conductor penetrated before the insulation of the other conductor is penetrated.

The upper surface of the post 300 also has a pair of spaced parallel slots 320 formed therein that extend orthogonal to the channels 310. The slots are contained within the opposing sides of the post 300 and the entrances to the slots 320 are advantageously chamfered to facilitate entry of the legs 220 of the contact 200 into the slots. The slots 320 are of a width to accommodate the associated legs 220, and the depth and the height of the slots exceed that of the channels 110.

Finally, the upper surface of the post 300 has a central cylindrical opening 330 formed therein to accommodate the screw terminal 100. The opening 330 is countersunk so that an upper portion 334 of the opening has a diameter and height slightly greater than that of the collar portion 140 of the screw terminal 100, while a lower portion 335 of the opening has a diameter slightly smaller than that of the threaded portion 150 of the screw terminal. The height of the lower portion 335 of the opening 330 is greater than the height of the threaded portion 150.

Figure 6:
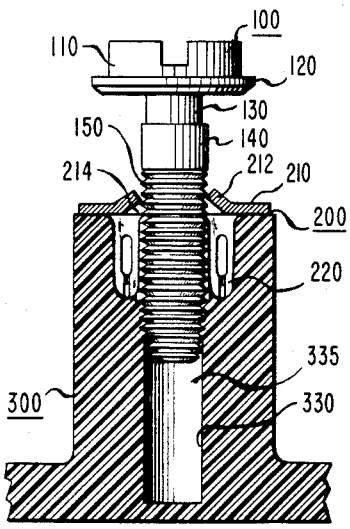
FIG. 6 is a sectional view orthogonal to FIG. 5 showing the elements of the embodiment in the process of being assembled.
Figure 7:
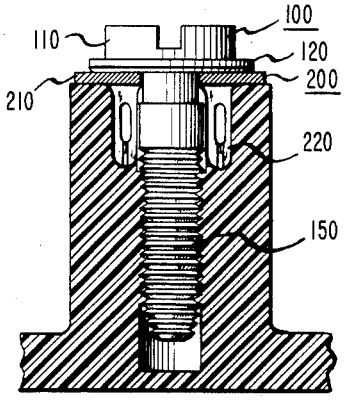
FIG. 7 is a sectional view showing the completion of the assembly operation.

Referring now to FIGS. 1, 6, and 7, in the assembly of these components, the contact 200 is first positioned on the post 300 with the legs 220 positioned within the slots 320. The threaded portion 150 of the screw terminal 100 is then inserted through the opening 214 in the base 210 of the contact 200 and threaded into the lower portion 335 of the opening 330 of the post 300. Since the threaded portion 150 of the screw terminal 100 has a self-tapping thread and since the diameter of the lower portion 335 of the opening 330 is smaller than the outside diameter of the threaded portion, the first insertion of the screw terminal forms the conforming internal thread in the wall of the lower portion.

As the screw terminal 100 is driven most of the way into the opening 330, the flange portion 120 underlying the head portion 110 engages the opposed tabs 212 adjoining the opening 214. As the screw terminal 110 continues to be driven into the opening 330, the flange portion 120 deflects the tabs 212 downwardly, and when the screw terminal is fully seated, the tabs are essentially moved into the plane of the remainder of the base 210. As a result, the contact 200 is captured on the neck portion 130 of the screw terminal 100. Thus, when the screw terminal 100 is screwed out of the post 300, the contact 200 is moved upwardly by the collar portion 140.

Figure 8:
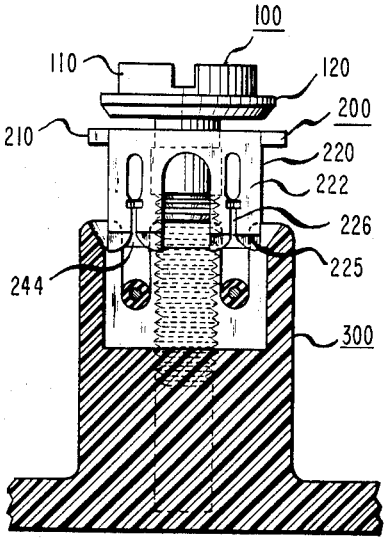
FIG. 8 is a sectional view parallel to FIG. 7 showing the connector arrangements arranged to accommodate an insulated conductor.
Figure 9:
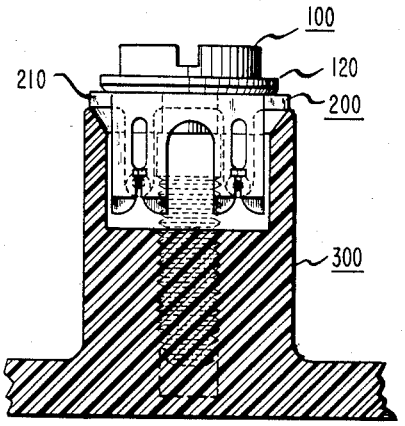
FIG. 9 is a sectional view showing the element having displaced the insulation and made electrical connection to the conductor.

Referring now to FIGS. 1, 8, and 9, in the operation of the connector assembly, the screw terminal 100 is unscrewed to raise the contact 200 to the point where the lower ends of the slotted beams 222 are at the upper ends of the channels 310 in the post 300. In this position, insulated conductors can be readily inserted into the channels 310. The insulated conductors advantageously traverse the entire length of the channels 310 so that each insulated conductor underlies a slotted beam 222 on each of the legs 220 of the contact 200. However, in some applications it may be desirable to interconnect a pair of conductors in a single channel 310, the conductor being inserted from opposite ends of the channel halfway into the channel. Furthermore, the channel 310 may include a wall at its midpoint to facilitate this arrangement.

With the insulated conductors in place, the screw terminal 100 is screwed into the post 300. Each insulated conductor is initially engaged by the beveled entry way 224 of the associated slotted beams 222. This stops downward movement of the contact 200 until the screw terminal 100 is turned in far enough for the flange portion 120 to engage the contact. At this point, further screwing in of the screw terminal 100 causes the ledge 225 on each furcation 223 to penetrate the insulation and shear it away from the conductor. Thereafter, the downward movement of the contact 200 results in the conductor being positioned within the engaging slots 226 of each associated slotted beam 222 whereby intimate physical engagement and thereby electrical connection is obtained between the conductor and the associated slotted beams. If each conductor is engaged by a pair of slotted beams, redundant electrical connection is achieved. Furthermore, electrical connection is provided between the conductors, the contact 200, and the screw terminal 100.

It is important to note that the connection to a pair of conductors need not be accomplished simultaneously. A single conductor may be initially connected to one opposed pair of slotted beams 222. Thereafter, when it is desired to add a second conductor the unscrewing of the screw terminal 100 moves the legs 220 of the contact 200 outwardly from the channels 310 and the connected conductor moves with the contact. Consequently, the second conductor can be inserted into the vacant channel 310, and when the screw terminal 100 is again screwed into place, connection is then made with the second conductor.

It is also to be noted that this connector assembly in addition to enabling connection to insulated conductors, enables connection to spade-tip terminals, bare-ended conductors and snap-on terminals. Spade-tip terminals and bare-ended conductors may be positioned between the flange portion 120 of the screw terminal 100 and the base 210 of the contact 200. Furthermore, both or multiples of these terminations may be positioned in place at the same time. Alternatively or additionally, a snap-on terminal may be applied to the head portion 110 of the screw terminal 100.

As stated previously, post 300 is advantageously molded as an integral element of an electrical component. Examples of such components are connecting blocks, station wire boxes, electrical outlet boxes, and junction boxes. In fact, it is clear that the connector assembly of the present invention can be used wherever a screw terminal is advantageously used. In addition, the connector assembly of the present invention can be used wherever customer installable wiring is desirable.

While the contact 200 has been disclosed with each leg 220 having a pair of slotted beams 222, in some applications it may be desirable to have three or more slotted beams on each leg. In addition, while the legs 220 have been disclosed as having equal numbers of slotted beams in alignment with one another, in some applications it may be desirable for the legs to have an unequal number of slotted beams or have the slotted beams staggered from one another.

Furthermore, while the contact 200 has been disclosed having the slotted beams 222 only on two sides of the contact in some applications it may be desirable to have the slotted beams on all four sides of the contact to provide two sets of slotted beams. In that situation, the slotted beams 222 will make connection to intersecting insulated conductors and therefore the post will contain intersecting channels 310 and slots 320. The channels 310 may have different heights in order for the intersecting insulated conductors to traverse through the post 300 and therefore the associated slotted beams 220 and slots 320 may also have different heights.

Still further, while the post 300 is disclosed as receiving a single contact 200, the post may be widened to accommodate two or more discrete contacts that are spaced from one another. One of these contacts 200 may be used for factory connection to conductors, while other of the contacts may be used for field connection to conductors. In this arrangement, the contacts 200 are advantageously electrically connected together by a bus bar-like conductive strip that is inserted beneath the bases 210 of adjacent contacts.

These and other modifications may be made without departing from the scope and spirit of this invention as defined by the appended claims.

What is claimed is:

1. The improvement in an electrical connector assembly comprising; a vertical terminal screw having a flanged top head, a bottom threaded stem, a collar between said head and stem, and a reduced diameter neck between said head and collar, an insulative post having therein a vertical passageway extending thereinto from the top thereof and including an upper part for receiving said collar and a lower part constituting a bore formed in said post to receive and threadingly engage with said stem, said post having formed therein two channels extending longitudinally therethrough on laterally opposite sides of said passageway for accommodation in such channels of respective electrical conductors, and said post also having formed therein two vertical slots extending downward from the top of said post and extending laterally therein on longitudinally opposite sides of said passageway so that each of said slots transects both said channels, and an electroconductive contact having a horizontal base with a central opening containing said screw's neck and of smaller diameter than said screw's head and collar so that said contact is retained in assembled relation with said screw, and sid contact also having two slotted beam portions which extend from longitudinally opposite ends of said base downward into respective ones of said slots, and each of which beam portions has furcations at its bottom for making electrical contact in the slot receiving that portion with electrical conductors in such channels; said improvement comprising the features that: (a) the bottoms of said channels are vertically above said bore in said post so as to be disposed on laterally opposite sides of, and within the vertical extent in said post occupied by, said upper part of said passageway in said post, and (b) each of said channels is laterally spaced from the centerline of said upper part of said passageway by a distance in the direction of spacing which is at least equal to the radius of said collar but is less than the sum of such radius and the thickness in such direction of the material in said post surrounding said bore.

2. The improvement according to claim 1 in which said collar of said screw is of greater diameter than said threaded stem of said screw.

3. The improvement according to claim 1 in which said upper part of said passageway in said post is surrounded at least partly around its periphery by material of said post forming bounding wall surface areas for such upper part.

4. The improvement according to claim 3 in which said upper part of said passageway is bounded on longitudinally opposite sides thereof by two separate portions of said post providing respective cylindrical bounding wall surface areas for such upper part which are radially symmetrically positioned relative to the centerline of such part, and which each occupy an arc of less than 180 degrees, said post portions on their laterally opposite sides being longitudinally spaced from each other by gaps which laterally open into said channels to permit close fitting between electrical conductors in said channels and the exterior of said collar when it is received in said upper part.

* * * * *